US005419060A

United States Patent [19]

Choi

[11] Patent Number: 5,419,060

[45] Date of Patent: May 30, 1995

[54] SHOE WITH DETACHABLE HEEL STRUCTURE

[76] Inventor: Jung S. Choi, 809-812, Joogong Apt., 611 Ilwon-dong, Kangnam-ku, Seoul, Rep. of Korea

[21] Appl. No.: 311,533

[22] Filed: Sep. 23, 1994

[30] Foreign Application Priority Data

Dec. 31, 1993 [KR] Rep. of Korea ..... 1993-31945

[51] Int. Cl.[6] ..... A43B 21/36

[52] U.S. Cl. ..... 36/36 R; 36/42

[58] Field of Search ..... 36/132, 136, 105, 42, 36/100, 36 R, 36 A, 36 B, 36 C, 15

[56] References Cited

U.S. PATENT DOCUMENTS

| | | | |
|---|---|---|---|
| 1,346,841 | 7/1920 | Padden | 36/42 |
| 3,188,755 | 6/1965 | Cortina | 36/42 |
| 3,432,945 | 3/1969 | Cesta | 36/36 R |
| 4,214,384 | 7/1980 | Gonzalez | 36/42 |
| 5,025,574 | 6/1991 | Lasher | 36/42 |
| 5,373,649 | 12/1994 | Choi | 36/42 |

*Primary Examiner*—David T. Fidei
*Assistant Examiner*—Beth Anne C. Cicconi
*Attorney, Agent, or Firm*—Dressler, Goldsmith, Shore & Milnamow, Ltd.

[57] ABSTRACT

A shoe with detachable heel structure. The shoe readily replaces a worn or damaged heel by a new one due to the detachable heel structure. The shoe has a detachable heel, a heel mounting block and a cushion sandwitched between the heel and the block. The heel has a coupling recess and a pair of coupling arms. The heel mounting block has a projecting insert engaged with the coupling recess, a pair of sliders, a pair of receptacle holes receiving the coupling arms, a pair of arm hooks fixed in the sliders and engaged with the coupling arms, a small diameter shaft telescopically received in a larger diameter shaft with a slider returning spring fitted over the shafts, a guide pin for guiding the rectilinear movement of each slider, and a predetermined length of guide slot receiving the guide pin therein. The shafts couple the sliders to each other so that the sliders are elastically moved in opposed directions.

1 Claim, 2 Drawing Sheets

SHOE WITH DETACHABLE HEEL STRUCTURE

BACKGROUND OF THE INVENTION

1. Field of the Invention

The present invention relates in general to a shoe with heel and, more particularly, to a shoe with detachable heel structure suitable for readily replacing a worn or damaged heel by a new one.

2. Description of the Prior Art

In walking while wearing shoes, the heel of a shoe naturally comes into contact with the ground ahead of the front part of the shoe sole. In order to provide a person in walking with pleasure in consideration of the above feature in walking, heels are fixed to the rear sections of the outer soles of the shoes using bonding agent, nails or the like. The heels are typically made of synthetic resin such as polyurethane for promoting the pleasure in walking. The heels of shoes are thus worn ahead of the other sections of the shoes, so that the heels may be replaced twice or three times as long as a pair of shoes are used. Furthermore, the heels may be damaged by strong impact often applied thereto during walking. In this case, the shoe wearer can not help enduring considerable inconvenience in walking before the shoes with the damaged heels are repaired by a repair shop.

SUMMARY OF THE INVENTION

It is, therefore, an object of the present invention to provide a shoe with detachable heel structure in which the above problems caused by the fixed heel can be overcome and whose heel worn or damaged is readily replaced by a new one due to the detachable heel structure.

It is another object of the present invention to provide a shoe with detachable heel structure which lets the heel itself be replaced by a new one.

In order to accomplish the above objects, a shoe with detachable heel structure in accordance with an embodiment of the present invention comprises: a detachable heel, a heel mounting block fixed to the rear section of an outer sole for detachably mounting the heel to the shoe, and a cushion sandwitched between the heel and the heel mounting block, which detachable heel has a coupling recess and a pair of coupling arms, the coupling recess being formed on the top center of the heel and engaged with the heel mounting block, and the coupling arms extending from a surface of the heel and adapted for preventing sudden separation of the heel from the block; which block has a projecting insert engaged with the coupling recess of the heel for keeping position of the heel relative to the block, a pair of sliders slidably received in the block so that the sliders are moved in opposed directions, a pair of receptacle holes receiving the coupling arms of the heel respectively, an arm hook fixed in each slider and engaged with an associated coupling arm of the heel, a small diameter shaft telescopically received in a larger diameter shaft with a slider returning spring fitted over the shafts, the shafts coupling the sliders to each other so that the sliders are elastically moved in opposed directions, a guide pin mounted on each of the sliders for guiding the rectilinear movement of each slider, and a predetermined length of guide slot receiving the guide pin therein, the guide slot being formed in the top wall of the heel mounting block.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
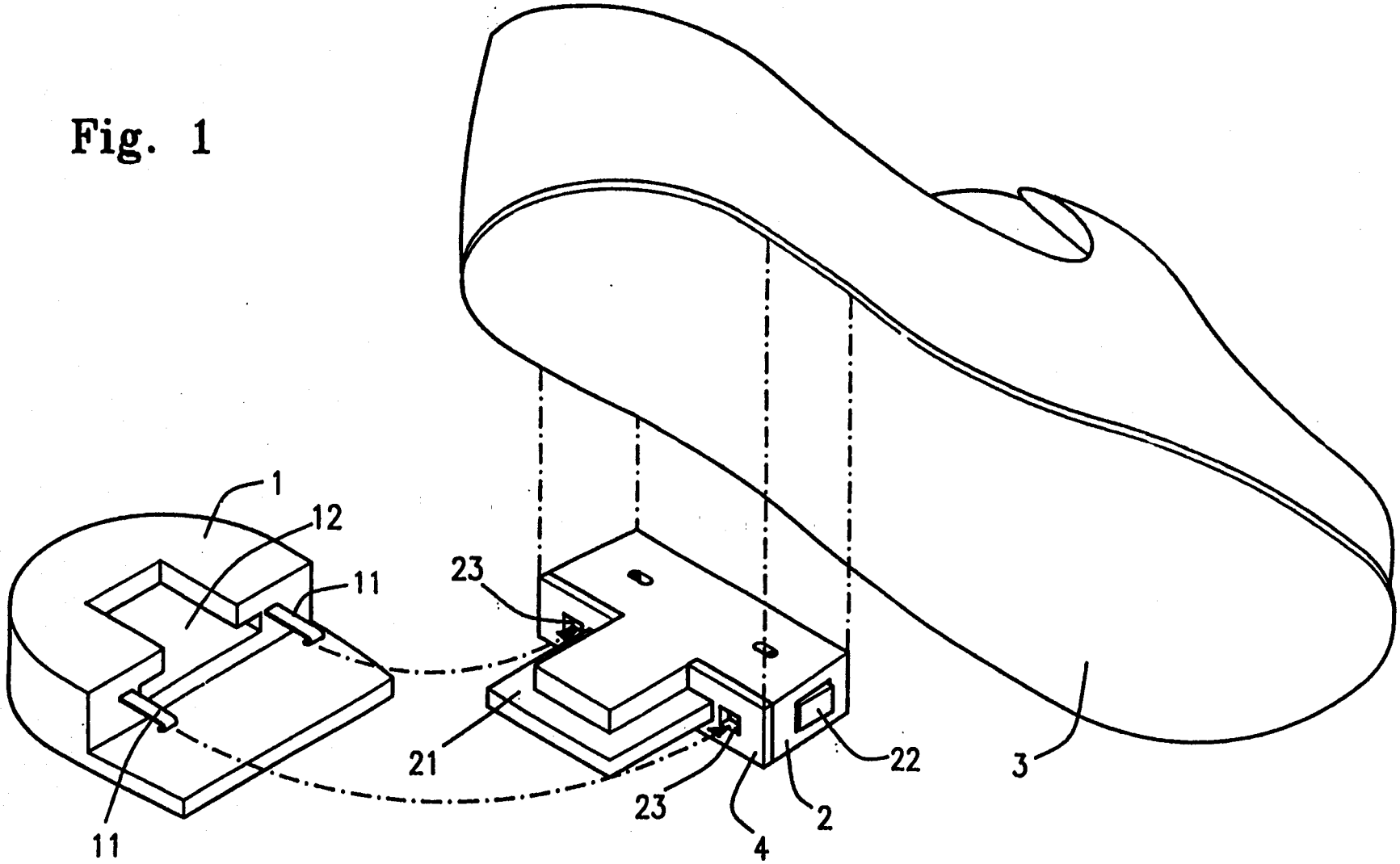
FIG. 1 is an exploded perspective view of a shoe with detachable heel structure in accordance with an embodiment of the present invention.
Figure 3:
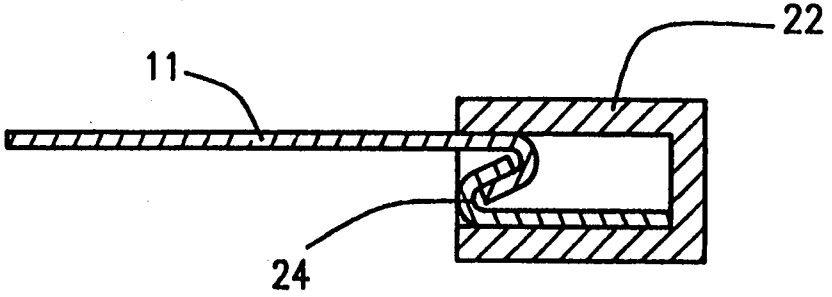
FIG. 3 is a sectional view showing engagement of the heel mounting block of FIG. 2 with a coupling arm of a detachable heel.
Figure 2:
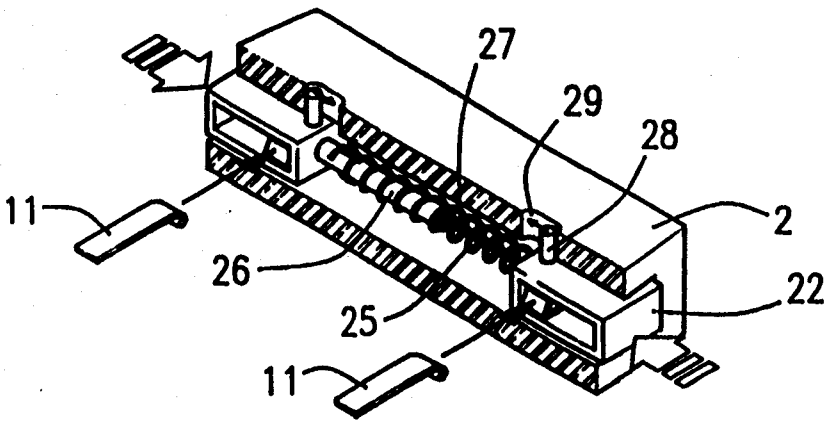
FIG. 2 is a partially sectioned perspective view of a heel mounting block fixed to the rear section of the outer sole of the shoe of FIG. 1.

Referring to FIG. 1, there is shown a shoe with detachable heel structure in accordance with a preferred embodiment of this invention. As shown in this drawing, the shoe has a detachable heel 1 and a heel mounting block 2 for detachably mounting the heel 1 to the shoe. The heel mounting block 2 is fixed to the rear section of an outer sole 3. Mounted on the heel mounting block 2 is a cushion 4 which will be sandwiched between the heel 1 and the block 2 when the heel 1 is detachably mounted to the block 2. The detachable heel 1 is stepped and has a coupling recess 12 on the top surface of the thicker part, which recess 12 opens to the front as well as to the top of the heel 1. This coupling recess 12 will be engaged with a male counterpart of the heel mounting block 2 when mounting the heel 1 to the block 2. Extending forward from the step surface of the stepped heel body are a pair of coupling arms 11 which will be inserted into receptacle holes 23 of the block 2 in order for preventing sudden separation of the heel 1 from the block 2. Meanwhile, the heel mounting block 2 has a projecting insert 21 or the above-described male counterpart which will be inserted into the coupling recess 12 of the heel 1. The insert 21 keeps the position of the heel 1 relative to the fixed block 2. The insert 21 is shaped so that it substantially meets with the recess 12. The block 2 also has a lateral through hole which slidably receives a pair of sliders 22 in opposed ends. The receptacle holes 23 for receiving their associated arms 12 of the heel 1 are formed in the block 2. Each of the sliders 22, which is hollowed, has an arm hook 24 which is fixed in the cavity of each slider 22 and will be engaged with a hook part of an associated arm 11 of the heel 1. The opposed sliders 22 are coupled to each other through a telescopic shaft which includes a small diameter shaft 25 telescopically received in a larger diameter shaft 26. Slider returning means or a compression coil spring 27 is fitted over the telescopic shaft and stopped by the opposed sliders 22. Each slider 22 also includes a guide pin 28 which is received in a predetermined length of guide slot 29 vertically formed in the top wall of the block 2. The rectilinear movement of each slider 22 in the lateral through hole of the block 2 is thus limited within the range defined by the length of an associated guide slot 29.

Differently from the typical heel, the detachable heel 1 of this invention is provided with both the coupling arms 11 and the coupling recess 12 which will be engaged with their respective counterparts of the block 2. That is, the coupling recess 12 is formed on the top surface of the thicker part of the stepped heel body and engaged with the projecting insert 21 of the block 2. The recess 12 is shaped so that it substantially meets with the insert 21 of the block 2.

Each coupling arm 11 of the heel 1 is shaped so that it is readily engaged with the arm hook 24 of an associated slider 22 of the block 2 and, therefore, prevents sudden separation of the heel 1 from the block 2.

As described above, the heel mounting block 2, which is adapted for detachably mounting the heel 1 to the shoe, is fixed to the outer sole 3 of the shoe.

The heel mounting block 2 has the projecting insert 21 which is inserted into and engaged with the coupling recess 12 of the heel 1, thus to keep the position of the heel 1 relative to the fixed block 2. The block 2 also has the pair of sliders 22 which are slidably received in opposed ends of the lateral through hole of the block 2. The receptacle holes 23 are formed in the block 2 for receiving their associated arms 12 of the heel 1. Each of the sliders 22 has the arm hook 24 which is fixed in the cavity of each slider 22 and engaged with the hook part of an associated arm 11 of the heel 1. The telescopic shaft including the small diameter shaft 25 telescopically received in the larger diameter shaft 26 couples the opposed sliders 22 to each other. The compression coil spring 27 fitted over the telescopic shaft and stopped by the opposed sliders 22 biases the sliders 22 outward. Each slider 22 is guided by its guide pin 28 which is received in the guide slot 29 of the block 2. The rectilinear movement of each slider 22 in the block 2 is limited within the range defined by the length of the guide slot 29.

The insert 21 of the block 2, which is inserted into the recess 12 of the heel 1 so as to fix the position of the heel 1 relative to the shoe, is formed with the block 2 in a single body. The insert 21 totally supports the heel 1 and transmits the load from a human foot to the heel 1.

The sliders 22, which are slidably placed in the block 2 so that they are rectilinearly moved in the block 2, have the arm hooks 24. The arm hooks 24 are engaged with their associated arms 11 of the heel 1 passed through the receptacle holes 23 of the block 2, thus to prevent sudden separation of the heel 1 from the block 2. Both the arms 11 and the arm hooks 24 are made of resilient metal plates and bent at their ends, thus to form the hook parts. When the arms 11 of the heel 1 pass through the receptacle holes 23 of the block 2 and are introduced into the sliders 22 by simply advancing the heel 1 toward the block 2, the hook parts of the arms 11 will be readily engaged with the hooks 24 due to the resilient hook structure of both the arms 11 and the hooks 24. Each arm 11 and an associated hook 24 are substantially engaged with each other due to their hook parts, so that the arms 11 and the hooks 24 prevent sudden separation of the heel 1 from the block 2 as far as the sliders 22 are not linearly inwardly moved in the block 2.

The sliders 22 received in the block 2 are coupled to each other through the telescopic shaft, having two shafts 25 and 26, with the compression coil spring 27 fitted over the telescopic shaft. When outside force is removed from the sliders 22 after pushing the sliders 22 inwardly against the spring force of the compression coil spring 27, the sliders 22 will be returned to their original positions due to the restoring force of the spring 27. Here, the telescopic shaft having the two shafts 25 and 26 not only causes the sliders 22 to be rectilinearly moved in opposed directions but also prevents possible bending of the coil spring 27.

Each guide pin 28, which is fixed to the top of an associated slider 22 and received in an associated slot 29 of the block 2, is moved within the slot 29, so that the pin 28 guides the rectilinear movement of the slider 22 in the block 2.

The cushion 4 is fixed to the block 2 and sandwiched between the heel 1 and the block 2 when mounting the heel 1 to the block 2. This cushion 4 allows the heel 1 to be slightly moved toward the block 2 when mounting the heel 1 to the block 2, thus to facilitate mounting of the heel 1 to the block 2. After engagement of the arms 11 of the heel 1 with the hooks 24 of the block 2, the heel 1 is retracted due to elasticity of the cushion 4, thus to achieve tight engagement of the arms 11 with the hooks 24.

The operational effect of the shoe with the detachable heel structure of this invention will be given hereinbelow.

Since the heel 1 is detachably mounted to the heel mounting block 2 fixed to the rear section of the outer sole 3 of the shoe as described above, the heel 1 is readily replaced by a new One when it is worn or damaged. In this regard, the shoe of this invention removes inconvenience caused by having the shoes with the worn or damaged heels repaired in a repair shop. The shoe of this invention may be always installed with heel which is not worn. Furthermore, the shoe may be selectively installed with one of varieties of heels suitable for varieties of walking conditions such as walking on mountains, walking on a mud road, and walking on a road paved with asphalt.

Although the preferred embodiments of the invention have been disclosed for illustrative purposes, those skilled in the art will appreciate that various modifications, additions and substitutions are possible, without departing from the scope and the spirit of the invention as disclosed in the accompanying claims.

What is claimed is:

1. A shoe with detachable heel structure comprising:

a detachable heel, said detachable heel having a coupling recess and a pair of coupling arms, said coupling recess being formed on the top center of the heel for engaging with a heel mounting block, and said coupling arms extending forward from a surface of the heel for preventing sudden separation of the heel from the block;

the heel mounting block fixed to the rear section of an outer sole and adapted for detachably mounting said heel to the shoe, said block having:

a projecting insert engaged with the coupling recess of the heel for keeping position of the heel relative to the block;

a pair of sliders slidably received in said block so that the sliders are moved in opposed directions;

a pair of receptacle holes receiving the coupling arms of the heel respectively;

an arm hook fixed in each of said sliders and engaged with an associated coupling arm of the heel;

a small diameter shaft telescopically received in a larger diameter shaft with a slider returning spring fitted over the shafts, said shafts coupling the sliders to each other so that the sliders are elastically moved in opposed directions;

a guide pin mounted on each of said sliders and adapted for guiding the rectilinear movement of each slider;

a predetermined length of guide slot receiving said guide pin therein, said guide slot being formed in the top wall of said heel mounting block; and a cushion sandwiched between the heel and the heel mounting block.

* * * * *